US005864057A

United States Patent [19]

Baird

[11] Patent Number: 5,864,057

[45] Date of Patent: Jan. 26, 1999

[54] METHOD AND APPARATUS FOR CONDUCTING WELL PRODUCTION TESTS

[76] Inventor: Jeffrey D. Baird, P.O. Box 337, Throckmorton, Tex. 76483

[21] Appl. No.: 850,915

[22] Filed: May 2, 1997

[51] Int. Cl.[6] ..... E21B 47/01; E21B 49/08

[52] U.S. Cl. ..... 73/152.38; 73/152.19; 166/250.01; 166/117.6

[58] Field of Search ..... 73/152.03, 152.17, 73/152.19, 152.22, 152.18, 152.23, 152.27, 152.28, 152.38, 152.16, 152.55; 166/250.01, 250.17, 114, 117.6, 133, 135, 195, 208

[56] References Cited

U.S. PATENT DOCUMENTS

| | | |
|---|---|---|
| 2,019,176 | 10/1935 | Dodds . |
| 2,300,823 | 11/1942 | Whitman . |
| 2,391,869 | 1/1946 | Bandy . |
| 2,456,331 | 12/1948 | Sewell . |
| 2,509,883 | 5/1950 | Rolshausen et al. . |
| 2,674,439 | 4/1954 | Chambers . |
| 3,059,695 | 10/1962 | Barry et al. . |
| 3,323,361 | 6/1967 | Lebourg . |
| 3,454,089 | 7/1969 | Brown . |
| 3,482,628 | 12/1969 | Griffin, Jr. . |
| 3,633,670 | 1/1972 | Brown et al. . |
| 4,116,274 | 9/1978 | Rankin et al. . |
| 5,337,838 | 8/1994 | Sorensen . |

OTHER PUBLICATIONS

*Flow Control Systems*, Baker Packers, A Division of Baker Oil Tools, Inc., pp. 598, 601, 602, 203; admitted to prior art.

*Primary Examiner*—Michael Brock
*Attorney, Agent, or Firm*—Geoffrey A. Mantooth

[57] ABSTRACT

A nipple is provided downhole as part of a tubing (drill string or production) string. The nipple has an interior passage with recesses therein and a seat. A data probe attached to a wireline traverses inside of the tubing from the surface to the nipple. The probe has a seal that seats inside of the nipple. The probe shuts in the well to allow formation fluid pressure to build. A first latch deploys into one of the recesses to retain the seal in place against the pressure. A bypass around the seal is provided. The bypass is kept closed against the pressure by a second latch that deploys into the other nipple recess. When the probe is to be retrieved to the surface, the bypass is opened to allow the pressure across the seal to equalize. The bypass is opened by unlatching the second latch. The seal is unseated by unlatching the first latch. The first and second latches are connected in series so as to operate sequentially, with the first latch deploying before the second latch. The probe has instrumentation and a sampling chamber which can be brought to the surface during flow periods of a test.

20 Claims, 8 Drawing Sheets

METHOD AND APPARATUS FOR CONDUCTING WELL PRODUCTION TESTS

FIELD OF THE INVENTION

The present invention relates to methods and apparatuses for conducting production tests of wells penetrating earth formations, such as oil and gas wells.

BACKGROUND OF THE INVENTION

In drilling oil and gas wells, the drilling operator desires to obtain production information on the earth formation of interest. Such information includes the type and quality of fluid (whether liquids or gases) that is produced by the formation, as well as the flow rate and pressure of the fluid. Such information is useful in determining the commercial prospects of the well. A well that shows satisfactory production capability may be completed, while a well that shows no commercial promise is typically plugged and abandoned, with no further drilling expense incurred.

The desired information is typically obtained by drill stem testing. When the drilling extends the borehole into the formation of interest, a drill stem test of the formation maybe initiated. To change over from drilling to a drill stem test, the drill stem is removed from the borehole and the drill bit is taken off. The drill stem is lowered back into the borehole, with a packer and testing equipment at the lower end of the drill stem. The testing equipment is lowered to the formation of interest.

In a conventional drill stem test, the testing equipment is provided with a four phase tool and a hydraulic tool. The four phase tool has a valve that is initially open, while the hydraulic tool has a valve that is initially closed. The valve in the four phase tool is opened and closed by rotating the drill stem in one direction for a specified number of revolutions. The four phase tool can only be actuated for four phases, and no more. The hydraulic tool is opened and closed by putting weight on the drill stem.

The testing equipment has a pressure recorder that operates during the entirety of the drill stem test. The information is recorded on a chart located in the recorder.

After the drill stem is positioned in the borehole, the formation is isolated from the drilling fluid (such as drilling mud) by setting the packer. The packer is set by putting weight on the drill stem. This action also opens the valve in the hydraulic tool, wherein fluid from the formation flows up into the drill stem. The hydraulic tool remains open, and the packer remains set, as long as weight is applied to the drill stem. The period of time where fluid flows into the drill stem is called the initial flow period.

After the initial flow period, the four phase tool is closed by rotating the drill stem a specified number of revolutions (for example, five revolutions). This begins the initial shut-in period, wherein the formation fluid pressure is allowed to increase. The increase in pressure is recorded by the pressure recorder.

After the initial shut-in period, the drill stem is rotated again a specified number of revolutions so as to open the four phase tool. This initiates the second flow period, wherein fluid from the formation enters the drill stem. The second flow period is followed by a second shut-in period, which is begun by rotating the drill stem the specified number of revolutions.

After the second shut-in period, the drill stem is raised to unseat the packer and close the hydraulic tool. Further testing is prohibited because the four phase tool can no longer be opened and closed; the tool has completed its four phases. Occasionally, further drill stem testing may be desired. Therefore, a disadvantage with the conventional drill stem test is a lack of flexibility in conducting extended repetitions of the flow and shut-in periods. If extended repetitions are required, then the four phase tool must be pulled from the borehole and reset at the surface. This adds to the cost of drilling the well.

Another disadvantage occurs in crooked boreholes. Because the four phase tool is opened and closed by rotating the drill stem, it is desirable to have the drill stem not be bound by the sides of the borehole. Unfortunately, in a crooked borehole, rotation of the drill stem may not be possible due to the contact of the drill stem with the sides of the borehole. In such a crooked borehole, a drill stem test cannot be conducted.

Still another disadvantage is the time involved for a drill stem test. A typical drill stem test may take 4.5–6 hours. The information being recorded is located in the pressure recorder at the bottom of the borehole. This information is not available for study until after the test is completed, wherein the testing equipment is pulled to the surface, along with the rest of the drill stem. Furthermore, a sample of the produced fluids is not available for study until the drill stem is pulled to the surface (the produced fluids are in the lower portion of the drill stem due to the flow periods).

In some wells, it becomes immediately apparent upon the retrieval of the information (whether the information is pressure, a fluid sample, etc.) that the well is unproductive. For example, if the well produces salt water or has depleted pressures, then the well is unproductive and will be abandoned. While the drill stem test is being conducted, the drilling equipment stands idled. Yet, the well owner still pays for the drilling equipment, even if idled. Unfortunately, in such unproductive wells, unnecessary expenses are incurred in the form of idled drilling equipment while awaiting the results of the drill stem test. The longer the drill stem test takes to complete, the more expense that is incurred for the idled drilling equipment.

There is in the prior art a downhole tool that transmits the information uphole during the drill stem test. An electrical wireline is used to transmit the information to the surface. Unfortunately, this procedure is very expensive and consequently is not used on many wells.

Once a well has entered into production, the well operator may, from time to time, wish to conduct production tests on that well. When the well is completed for production, a seat nipple is provided just above the packer (the packer isolates the formation). Production tubing extends from the seat nipple up to the surface.

To conduct a production test on the well, a pressure recorder is lowered inside of the tubing to the seat nipple. Then, a surface valve on the tubing is closed to shut in the well. The well is typically shut-in for about 24–72 hours. The test takes a long time because pressure must build up in the tubing from the formation all the way up to the surface. After being shut-in for an extended period of time, the pressure recorder is retrieved to the surface to access the recorded information inside.

The disadvantage to this type of production test is the long period of time needed to conduct the test. A production well may be damaged if it is shut-in for too long. This is because the build up of pressure inside the well could undesirably fracture the formation. As a result, many operators or owners do not subject certain wells to production tests.

SUMMARY OF THE INVENTION

It is an object of the present invention to provide a method and apparatus for conducting a well production test that provides test information to the surface while the test is ongoing.

It is a further object of the present invention to provide a method and apparatus for conducting a drill stem test.

It is a further object of the present invention to provide a method and apparatus for conducting a production well test.

The present invention provides an apparatus for testing the production capability of a well extending into an earth formation. The apparatus has a nipple having first and second ends and an interior passage extending between the first and second ends. The nipple has a longitudinal axis extending between the first and second ends. The first and second ends are structured and arranged to be coupled to a well tubing such that the interior passage communicates with a passage inside of the well tubing. The nipple comprising first and second recesses in the interior passage, the first and second recesses being spaced apart from each other longitudinally along the interior passage. The nipple comprising a seat in the interior passage. A probe has two ends and is structured and arranged to traverse through the passage of the well tubing. The probe having a seal that cooperates with the nipple seat in the interior passage so as form a seal in an annular region between the probe and the nipple. The probe comprising an information gathering member that is located at one of the ends of the probe. The probe comprising a wireline coupler that is located at the other of the ends of the probe, the wireline coupler being structured and arranged to be coupled to a wireline. The probe comprising a bypass member that extends through an interior of the seal, the bypass member having a bypass passageway. The bypass member being moveable relative to the seal between an open position and a closed position, with the bypass passageway allowing fluid in the interior passage of the nipple to flow past the seal when the bypass member is in the open position, and with fluid in the interior passage of the nipple being prevented from flowing past the seal when the bypass member is in the closed position. The probe comprising first and second latches, the first latch being connected to the seal, the second latch being connected to the bypass member, the first latch being structured and arranged to be received by the first recess in the nipple and the second latch being structured and arranged to be received by the second recess in the nipple, each of the first and second latches being moveable between a deployed position, wherein the respective first or second latch is received by the respective first or second recess, and a stowed position, wherein the respective first or second latch is clear of the respective first or second recess so as to allow the probe to traverse through the interior passage, the first and second latches being connected together in series so as to move between the respective deployed and stowed positions sequentially.

In accordance with one aspect of the invention, the first latch comprises first and second linkages, each of the first and second linkages having a first end and a second end, with the second ends of the first and second linkages being pivotally coupled together, the first end of the first linkage being pivotally coupled to the seal, the first end of the second linkage being pivotally coupled to an intermediate member, the intermediate member being coupled with the wireline coupler.

In accordance with another aspect of the invention, the apparatus further comprises a roller rotatably coupled to the second ends of the first and second linkages.

In accordance with another aspect of the invention, the first recess comprises a shoulder surface for receiving and retaining the second ends of the first and second linkages.

In accordance with another aspect of the invention, each of the first and second linkages have a longitudinal axis between the respective first and second ends, the angle between the longitudinal axes of the first and second linkages being about 86–91 degrees when the first latch is in the deployed position.

In accordance with another aspect of the invention, the intermediate member is coupled to the wireline coupler by way of the second latch.

In accordance with another aspect of the invention, the intermediate member is coupled to the wireline coupler by way of the second latch and a spring.

In accordance with another aspect of the invention, the intermediate member is coupled to the bypass member by way of a pin and slot arrangement, with the slot being oriented so as to permit the pin to alternately traverse towards the first and second ends of the probe.

In accordance with another aspect of the invention, the second latch comprises third and fourth linkages, each of the third and fourth linkages having a first end and a second end, with the second ends of the third and fourth linkages being pivotally coupled together, the first end of the third linkage being pivotally coupled to the bypass member, the first end of the fourth linkage being pivotally coupled to the wireline coupler.

In accordance with another aspect of the invention, the information gathering member comprises a pressure sensing instrument.

In accordance with another aspect of the invention, the information gathering member comprises a sampling chamber.

The invention also provides an apparatus for testing the production capability of a well extending from the surface of the earth into a formation. The apparatus has a tubing extending along the inside of the well from the surface to the formation, the tubing having an interior passage therein, which passage extends from the surface to the formation. The tubing having a packer at a location above the formation. The tubing having a nipple therein, the nipple located above the packer. The interior passage passing through the nipple. The nipple having two recesses in the interior passage, the recesses being longitudinally spaced apart from each other. The nipple having a seat in the interior passage. A probe having a seal that is structured and arranged to engage the nipple seat. The probe having an information gathering member located so as to be exposed to fluid from the formation when the seal engages the nipple seat. The probe comprising a bypass member that extends through an interior of the seal, the bypass member having a bypass passageway, the bypass member being moveable relative to the seal between an open position and a closed position, with the bypass passageway allowing fluid in the interior passage to flow past the seal when the bypass member is in the open position, and with fluid in the interior passage being prevented from flowing past the seal when the bypass member is in the closed position. The probe comprising first and second latches, the first latch being connected to the seal, the second latch being connected the bypass member, the first latch being structured and arranged to be received by one of the recesses in the nipple and the second latch being structured and arranged to be received by the other of the recesses in the nipple, each of the first and second latches being moveable between a deployed position, wherein the respective first or second latch is received by the respective recess in the nipple, and a stowed position, wherein the respective first or second latch is clear of the respective recess so as to allow the probe to traverse through the interior passage, the distance between the two recesses in the nipple being smaller than the distance between the first and second latches when the first and second latches are in the stowed position.

In accordance with one aspect of the invention, the tubing comprises a drill stem.

In accordance with another aspect of the invention, the tubing comprises production tubing.

The invention also provides a method of testing the production of a well, the well extending from the surface of the ground into a formation, the well having a length of tubing from the surface to the formation, the tubing having an interior passage therein, which interior passage communicates with the formation, the well being packed off in an annulus around the tubing at a location that is above the formation, wherein fluid from the formation is allowed to enter the interior passage of the tubing. The method comprises dropping a probe inside of the interior passage, the probe having a seal and a bypass around the seal. The probe seal is seated into a portion of the tubing. The seal is latched in place by deploying a first latch on the probe so as to engage the tubing. The bypass is closed around the seal. The bypass is latched in a closed position by deploying a second latch on the probe so as to engage the tubing, wherein the well is shut in. The second latch is unlatched from the tubing. The bypass is opened around the seal so as to open the well. Pressure across the seal is equalized through the bypass. The first latch is unlatched from the tubing. The seal is unseated from the tubing. The probe is retrieved to the surface.

In accordance with one aspect of the invention, the probe is provided with instrumentation and while the well is shut in, well phenomena is monitored with the instrumentation.

In accordance with another aspect of the invention, the top end of the probe is provided with a weight. After the probe seal seats into a portion of the tubing, the weight is driven down so as to deploy the first latch on the probe. After deploying the first latch on the probe, the weight is continued to be driven down so as to close the bypass and deploy the second latch on the probe.

In accordance with another aspect of the invention, the step of dropping a probe inside of an interior passage further comprises the step of connecting a wireline to the probe and dropping the probe with the wireline inside of the interior passage. The wireline is maintained in connection with the probe. The step of unlatching the second latch from the tubing further comprises the step of picking up with the wireline a predetermined distance. The step of unlatching the first latch from the tubing further comprises the step of picking up with the wireline a further distance.

In accordance with another aspect of the invention, the method occurs during a shut-in period of a drill stem test. After the well is opened by opening the bypass, the well is allowed to flow for a period of time.

With the present invention, pressure measurements, fluid samples, and other information about a well can be obtained inexpensively, quickly and without interrupting an ongoing test. With a mechanical version of the probe, expensive electrical wireline equipment is not required, yet results of the test can be obtained quickly. The probe is left downhole only as long as necessary to shut in the well. The probe, with its information, is retrieved to the surface during flow periods. The probe can be implemented using an electrical wireline if so desired.

The probe works as part of the test. In a typical drill stem or production well test, the well is shut in to allow the build up of formation pressures. The well is shut in by the probe seating in the nipple. Unseating the probe allows the well to flow. During the flow period the probe can be brought to the surface to analyze the information. The probe can be dropped back in the well for continued repetitions of the shut-in and flow cycles. Because the nipple is located near the formation, the entire string of tubing up to the surface need not be pressurized. This speeds the test in a production well Crooked boreholes can be tested with the invention. Unlike conventional testing tools, rotary movement of the drill stem is not required to shut in the well. Instead, the well is shut in and opened with up and down (vertical) movements.

DESCRIPTION OF THE PREFERRED EMBODIMENT

Figure 1:
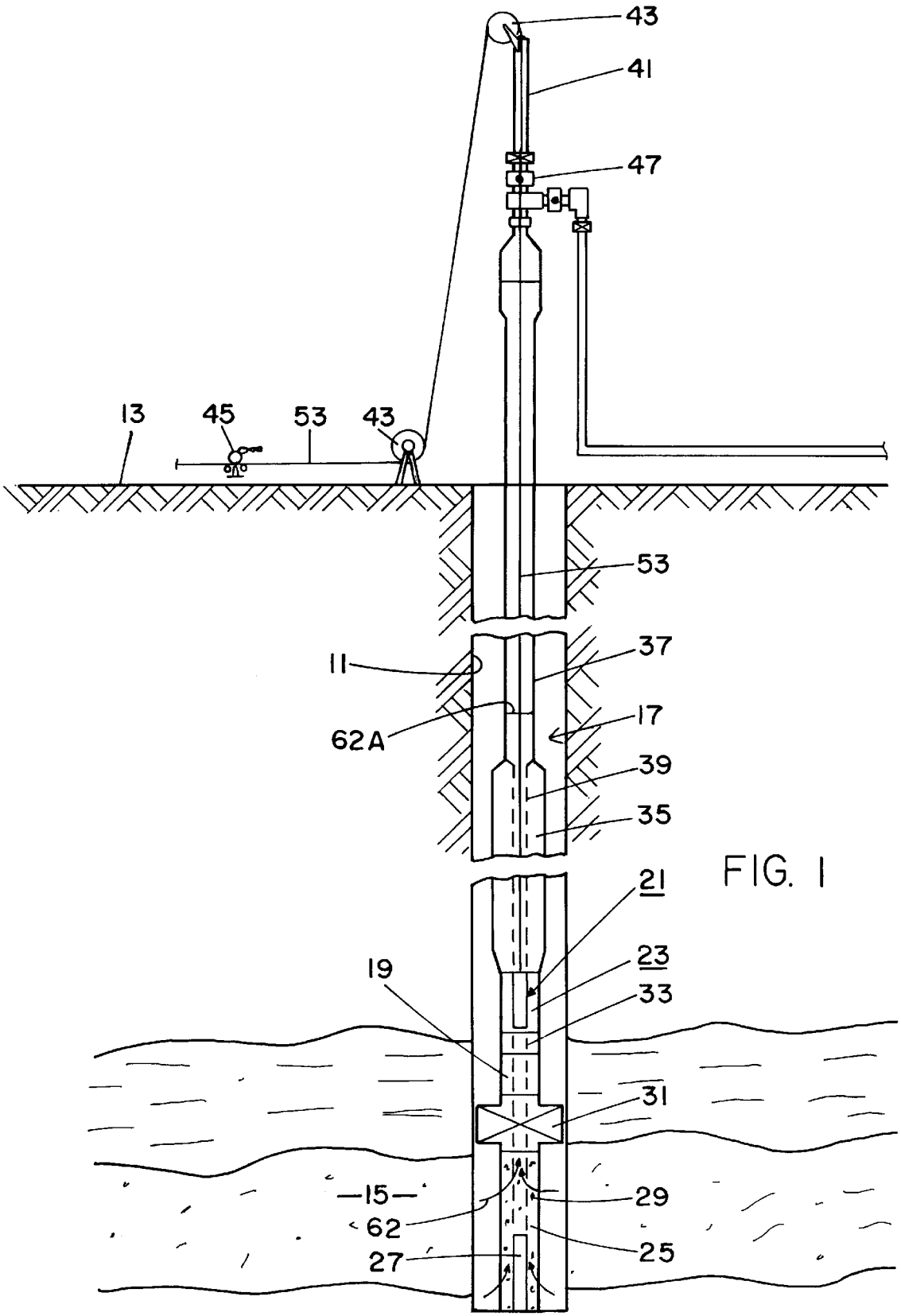
FIG. 1 is schematic longitudinal cross-sectional view of a well containing equipment for conducting a drill stem test, which equipment includes the apparatus of the present invention.

In FIG. 1, there is shown a cross-sectional view of an oil or gas well. The well has a borehole 11 that extends from the surface 13 to an earth formation 15. The formation is of interest for its potential oil or gas production capability.

In order to determine the production capability of the formation 15, a drill stem test is conducted. The test uses a drill stem 17 that extends from the surface 13 inside of the borehole 11 to the formation 15. Located in the borehole 11 is a test tool 19. The test tool 19 remains in the borehole for the duration of the test.

In a conventional drill stem test, a pressure recorder 27 is located in the drill stem. The pressure recorder typically records formation pressure on a chart. The pressure recorder 27 is seated inside of an anchor 25 below a packer 31 and therefore remains downhole for the duration of the test. (Another pressure recorder is typically provided in a bomb carrier above the packer. This recorder also remains downhole for the duration of the test.) The drill stem test includes several shut-in and flow periods. In order to retrieve the pressure recorder, the entire drill stem 17 must be pulled to the surface 13.

The present invention uses a data probe 21 that traverses up and down inside of the drill stem 17. The data probe seats inside of a nipple 23 that is located above the formation 15. By seating the data probe 21 inside of the nipple 23, the well becomes shut-in. The data probe 21 contains instrumentation (such as a pressure recorder) as well as a sampling chamber. When the time arrives to open the well for a flow period, the data probe is released from the nipple 23. This opens the drill stem to fluid (liquid or gas) flow from the formation and also allows the data probe to be retrieved to the surface. The drill stem test continues unhindered while the data probe is retrieved and its recorded information and fluid sample are analyzed. If the well is producing salt water, or has other indications of unproductiveness (such as depleted pressures), then the drill stem test can be halted at that time. This saves time and thereby reduces the expenses of drilling. If the well shows promise, then the drill stem test can be continued, using either the data probe to shut-in the well for the second and subsequent shut-in periods, or using the conventional downhole four phase tool which is in the test tool 19.

To conduct a drill stem test, the well is readied by lowering a length of drill stem 17 therein. At the bottom end of the drill stem 17 is an anchor 25. The anchor 25 is an extra heavy pipe that is perforated 29 to allow fluid from the formation to enter the drill stream. The perforations 29 are small enough to prevent large cuttings from entering the drill string. Inside of the anchor 25 is the pressure recorder 27 for recording various parameters such as pressure and temperature. Located above the anchor is the packer 31. Located above the packer is a safety joint (not shown) and the test tool 19. The test tool 19 has a four phase tool and a hydraulic tool therein. The anchor 25, the pressure recorder 27, the packer 31, and the test tool 19 are all conventional and commercially available. Located above the test tool 19 is a bomb chamber or carrier, the nipple 23, drill collars 35, and drill pipe 37. The drill pipe 37 extends all the way to the surface 13. The drill stem includes all of these components 25, 31, 19, 33, 23, 35, and 37. An interior passage 39 is provided inside of the drill stem 17, and extends from the surface 13 down into the anchor 25, where the passage communicates with the perforations 29.

There is provided surface equipment, which includes a derrick (not shown), a lubricator 41, wireline equipment, such as sheaves 43 and a drum (not shown), and a wireline measuring device 45. The lubricator 41 is located at the top of the drill pipe 37. A valve 47 is provided between the lubricator 41 and the drill stem 17. The interior of the lubricator 41 communicates with the passage 39.

The data probe 21 is lowered and raised within the drill stem 17 by a wireline 53. The wireline 53 can be either a slickline (mechanical cable) or an electrical line (with a mechanical cable and electrical conductors). If an electrical wireline is used, then data can be sent from the data probe up to the surface over the electrical line. If an electrical wireline is used, the data probe can be left downhole for the duration of the test. The data probe is manipulated to alternatively open and shut-in the well, in a manner to be described hereinafter.

The specifics of the data probe 21 and the nipple 23 will now be discussed. As used herein, the terms "upper", "lower", "above", and "below" refer to the orientation of the equipment in the borehole 11 and shown in the drawings.

Figure 2:
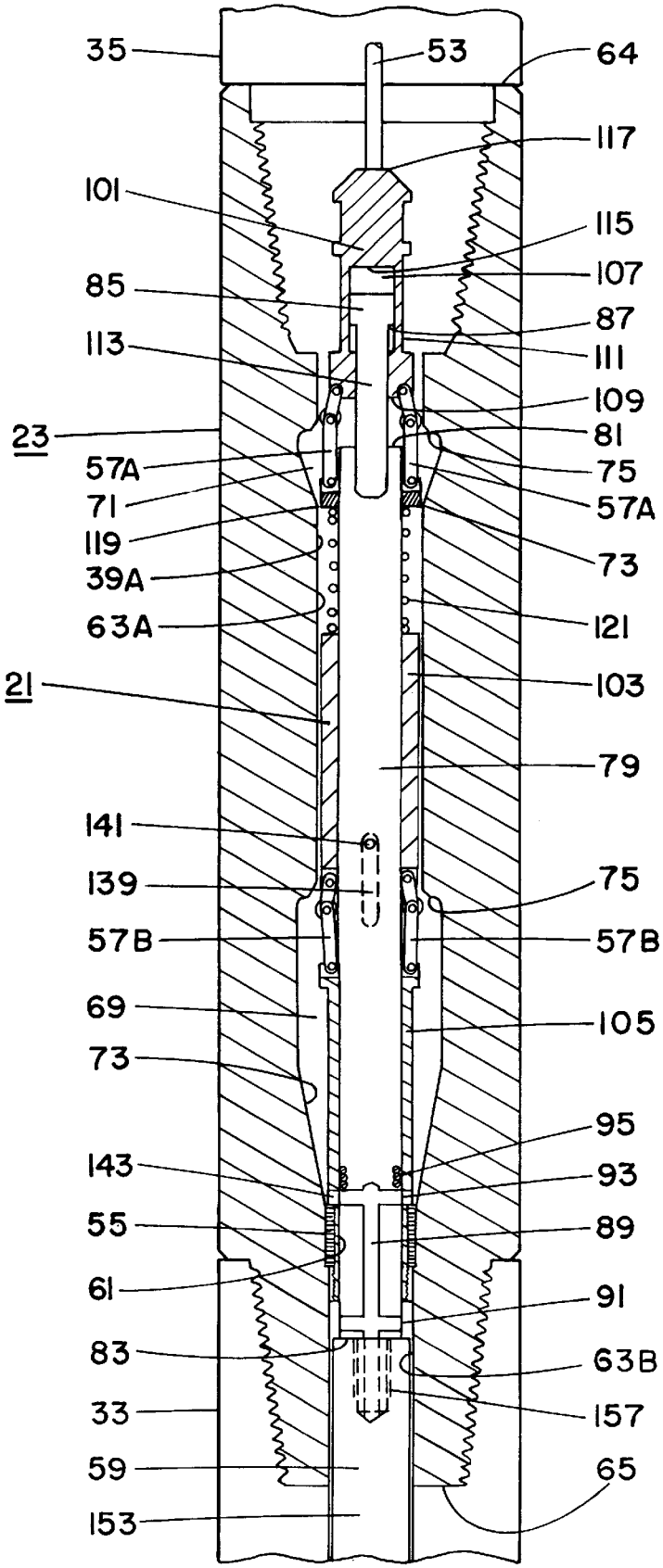
FIG. 2 is a longitudinal cross-sectional view of the nipple and data probe of the present invention, in accordance with a preferred embodiment. The data probe is shown seated in the nipple, with its latches unlatched.

As shown in FIG. 2, the data probe 21 includes packing 55, latches 57A, 57B, and an instrumentation carrier 59.

Figure 5:
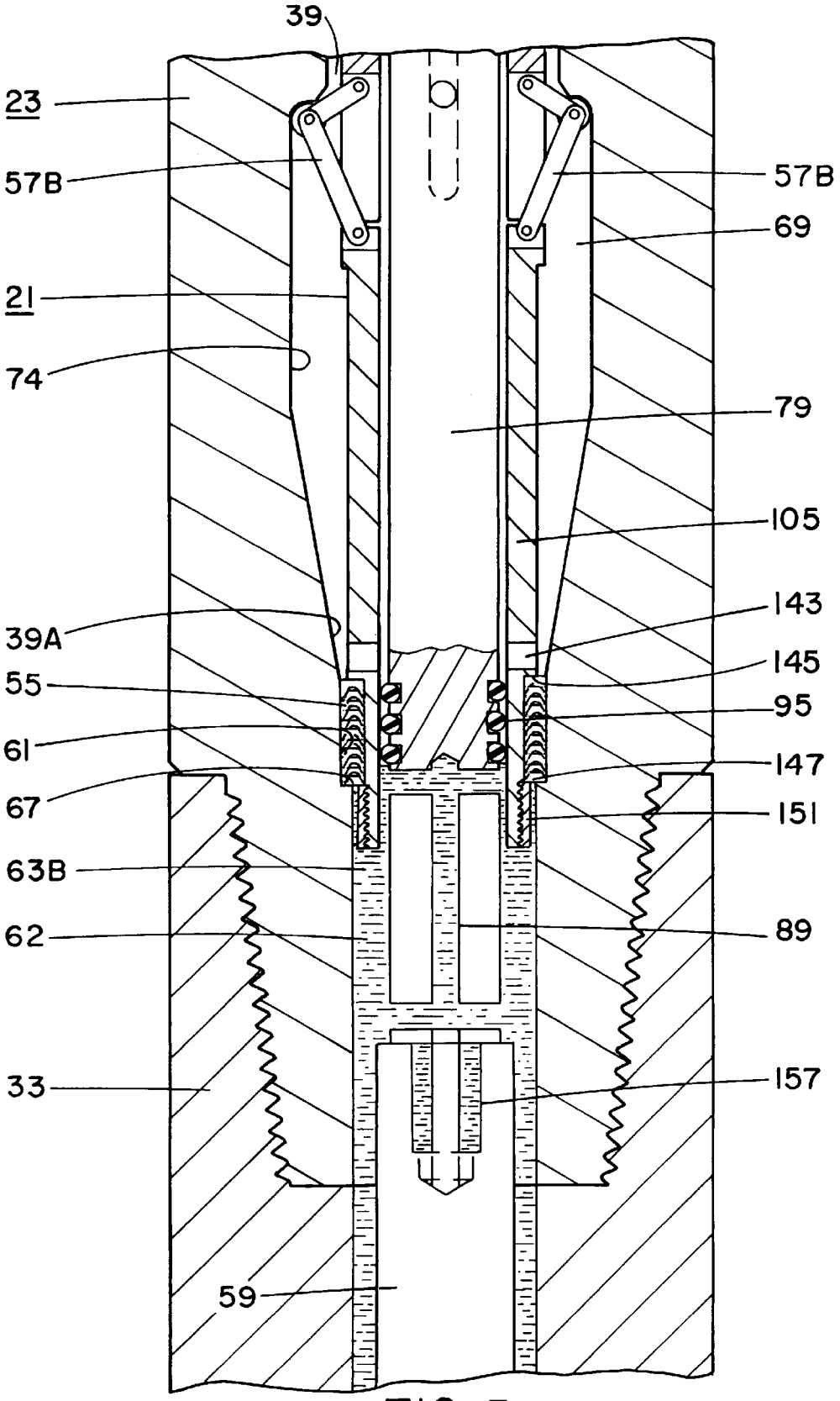
FIG. 5 is longitudinal cross-sectional close up view of the bottom portion of the data probe as seated in the nipple in the shut-in position.

Referring to FIG. 5, the packing 55 of the data probe 21 engages a packing seat 61 on the nipple 23 to seal off the passage 39 inside of the drill stem. Once a seal is made between the data probe 21 and the nipple 23, fluid cannot be produced up past the nipple. (Referring to FIG. 1, the annulus around the drill stem 17 is sealed off by the packer 31. The packing 55 (see FIG. 5) seals the inside of the drill stem 17.) The latches 57A, 57B of the data probe engage the nipple 23 so as to maintain the data probe in place inside of the nipple, even under pressure. Once the packing 55 forms a seal with the nipple 23, the fluid from the formation will exert pressure on the bottom of the data probe. The latches 57A, 57B resist this fluid pressure to maintain the seal.

The instrumentation carrier 59 is located beneath the packing 55 so as to be exposed to the formation fluid 62. The instrumentation carrier 59 contains instrumentation (such as a pressure recorder and/or a temperature recorder) and a fluid sample chamber.

Figure 3:
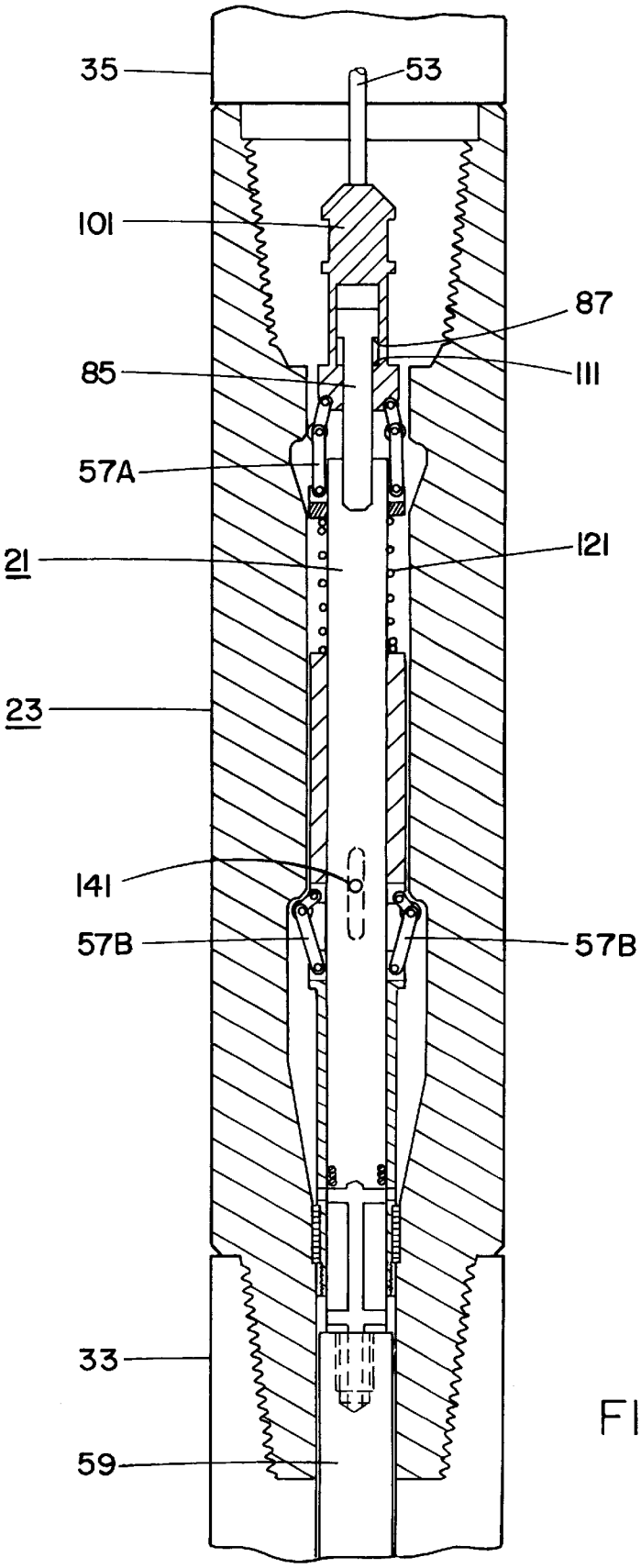
FIG. 3 is longitudinal cross-sectional view of the nipple and data probe of FIG. 2, shown with the data probe partially set or latched.

The nipple 23 will now be described in more detail, followed by a more detailed description of the data probe 21. Referring to FIGS. 2 and 3, the nipple 23 has an interior passage 39A located therein. The interior passage 39A forms a part of the overall interior passage 39 (see FIG. 1) of the drill stem 17. The interior passage 39A includes an upper portion 63A, the packing seat 61, and a lower portion 63B. The nipple 23 has a top end 64 and a bottom end 65, which are threaded so as to couple to other elements of the drill stem. The top end 64 is coupled to a drill collar 35, while the bottom end 65 is coupled to the chamber 33. Located near the bottom end 65, in the interior passage 39A, is the packing seat 61. The packing seat 61 is a polished cylindrical surface. Below the packing seat 61 is a shoulder 67 (see FIG. 5) that projects inwardly and that merges with the lower portion 63B of the interior passage 39A. The inside diameter of the packing seat 61 is larger than the inside diameter of the lower portion 63B of the interior passage 39A. The inside diameter of the packing seat 61 is smaller than the inside diameter of the upper portion 63A of the interior passage 39A.

Figure 7:
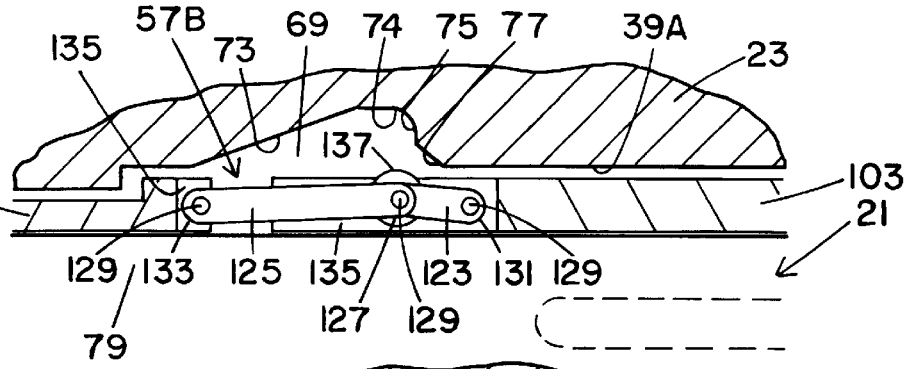
FIGS. 7–11 show close up views of a latch in various positions relative to the nipple during the deployment and release of the latch.

Located above the packing seat 61 in the interior passage 39A is a lower latch groove 69. Located above the lower latch groove 69 is an upper latch groove 71. Each groove 69, 71 represents an increase in the diameter of the interior passage 39A of the nipple 23. The grooves 69, 71 receive the latches 57A, 57B of the data probe. Each groove extends around the entire circumference of the interior passage 39A. The grooves 69, 71 are substantially similar to each other. The description that follows is applicable to both the lower and the upper grooves 69, 71. Referring to FIG. 7, which shows a close up cross-section of the lower groove 69 the lower end of each groove has a frusto-conical surface 73. The upper end of the frusto-conical surface merges with a cylindrical surface 74, which in turn merges with a shoulder 75. The shoulder 75 is located in the upper end of each groove and merges with a chamfered or bevelled surface 77, which chamfered surface merges with the cylindrical surface forming the interior passage 39A. (Two variations in the lower groove are shown in FIGS. 5 and 7. In FIG. 5, the cylindrical surface 74 is longer than the cylindrical surface 74 in FIG. 7. Thus, the lower groove can be made longer or shorter.) The shoulder 75 in each groove is oriented 90 degrees to the longitudinal axis of the nipple.

For machining purposes, the nipple 23 may be divided by a transverse joint in the middle, so as to allow boring of the grooves 69, 71.

The specifics of the data probe will now be described with reference to FIG. 2. The data probe 21 has a traveling shaft 79. The traveling shaft 79 forms a mandrel for the latches 57A, 57B and the packing 55 of the data probe. In addition, the traveling shaft provides a bypass 89 around the packing 55. The traveling shaft also provides a mount for the instrumentation carrier 59.

The traveling shaft 79 has an upper end 81 and a lower end 83. Attached to the upper end 81 of the traveling shaft 79 is a head bolt 85. The upper end of the bolt 85 has a flange 87. The head bolt 85 extends longitudinally from the upper end 81 of the traveling shaft. The instrumentation carrier 59 is attached to the lower end 83 of the traveling shaft 79. The traveling shaft 79 has a bypass passageway 89 near its lower end 83. The bypass 89 has lower ports 91 and upper ports 93. Located above the upper ports 93 are circumferential grooves, which receive O-rings 95.

The latch mechanism of the data probe will be described next. The latch mechanism actuates the latches 57A, 57B and includes a wireline retrieval head 101, upper and lower toggle latches 57A, 57B and upper and lower skirts 103, 105.

The wireline retrieval head 101 is located at the upper end 81 of the traveling shaft 79. The wireline retrieval head 101 has a bore 107 that opens at the lower end 109 of the head 101. Near the bore opening 109 is a shoulder 111 that cooperates with the flange 87 of the head bolt 85. Thus, the wireline retrieval head 101 can move longitudinally along the shank 113 of the head bolt 85. However, movement of the retrieval head 101 is limited in the up direction by the flange 87 and the shoulder 111, while movement of the retrieval head 101 is limited in the down direction by the end 115 of the bore 107 abutting the bolt 85. The upper end 117 of the wireline retrieval head 101 is coupled to an end of the wireline 53. If additional weight is required, then sinker bars can be coupled to the wireline retrieval head 101.

Located around the traveling shaft 79 are a ring 119, the upper skirt 103, and the lower skirt 105. Each of the ring 119 and the upper and lower skirts 103, 105 is cylindrical. The ring 119 is located near the upper end 81 of the traveling shaft 79. The upper toggle latches 57A are coupled to the wireline retrieval head 101 and the ring 119. The ring 119 is threadingly coupled to the traveling shaft 79 so as to move in unison therewith. Located below the ring is a helical coil spring 121, followed by the upper skirt 103. The lower skirt 105 is located below the upper skirt 103. The lower toggle latches 57B are coupled to the upper and lower skirt 103, 105. The upper and lower skirts 103, 105, and the spring 121 can slide up and down along the traveling shaft 79.

The upper and lower toggle latches 57A, 57B move between two positions, namely the stowed position and the deployed position. The toggle latches 57A, 57B are shown in the stowed position in FIG. 2. In the stowed position, the toggle latches 57 are pulled in close to the traveling shaft 79. With the toggle latches in the stowed position, the data probe 21 can move up and down inside of the drill stem 17. The toggle latches 57A, 57B are shown in the deployed position in FIG. 4. The deployed position is used to lock the data probe 21 in place relative to the nipple 23.

The latches 57A, 57B are substantially similar to each other. Referring to FIG. 7 each latch 57A, 57B includes an upper linkage bar 123 and a lower linkage bar 125. (FIG. 7 illustrates only the lower toggle latch 57B.) One end of the upper linkage bar 123 is pivotally coupled to one end of the lower linkage bar 125, so as to form an elbow 127. The other end 131 of the upper linkage bar 123 is pivotally coupled to either the upper skirt 103 or the wireline retrieval head 101. Specifically, in each upper toggle latch 57A, the other end 131 of the upper linkage bar 123 is pivotally coupled to the lower end of the wireline retrieval head 101 (see FIG. 2). In each lower toggle latch 57B, the other end 131 of the upper linkage bar 123 is pivotally coupled to the lower end of the upper skirt 103 (see FIG. 7). Likewise, the other end 133 of the lower linkage bar 125 is pivotally coupled to either the ring 119 or the lower skirt 105. Specifically, in the upper toggle latch 57A, the other end 133 of each of the lower linkage bars 125 is pivotally coupled the ring 119 (see FIG. 2). In the lower toggle latch 57B, the other end 133 of each of the lower linkage bars 125 is pivotally coupled to the upper end of the lower skirt 105 (see FIG. 7). Notches 135 for receiving the respective ends of the linkage bars 123, 125 are formed in the lower end of the wireline retrieving head 101, the upper end of the ring 119, the lower end of the upper skirt 103, and the upper end of the lower skirt 105. The pivotal coupling can be accomplished by way of pins 129.

In the preferred embodiment, the elbow of each latch 57A, 57B has a roller 137 thereon. The latches need not be provided with rollers. However, the roller eases the deployment of the latch into and out of the respective groove. The roller 137 is interposed between the two linkage bars 123, 125.

In the preferred embodiment, there are two upper toggle latches 57A and two lower toggle latches 57B (see FIG. 2). The two upper toggle latches are spaced 180 degrees apart from each other. The two lower toggle latches are also spaced 180 degrees apart from each other. Each set of upper and lower latches can include less than or more than two latches.

Figure 10:
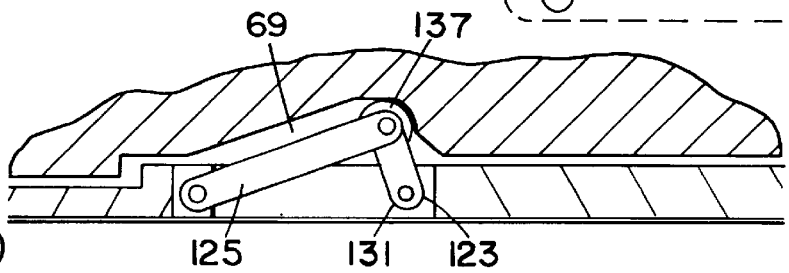

Each linkage bar 123, 125 has a longitudinal axis that extends between its pivot points. The angle between the longitudinal axes of the upper and lower linkage bars varies in accordance with position of the latch. Referring to FIG. 7, when the latch in the stowed position, the angle between the upper and lower linkage bars 123, 125 is slightly less than 180 degrees (for example, 168–175 degrees). The latch is thus bowed slightly outward towards the nipple 23. This slight bowing insures that the latch does not jam upon deployment. Referring to FIG. 10, when the latch is in the deployed position, the angle between the upper and lower linkage bars 123, 125 is about 86–91 degrees (in the preferred embodiment, the angle is about 89 degrees).

Referring to FIG. 2, the spring 121 between the ring 119 and the upper skirt 103 serves to act as a shock absorber while transferring forces between the latches 57A, 57B. The respective ends of the spring are coupled to the ring and the upper skirt.

The upper skirt 103 is provided with a longitudinal slot 139 (shown in dashed lines in the cross-sectional views) along a portion of its length. The slot is located between the latches 57B. The slot 139 receives a shear pin 141, which pin is coupled to the traveling shaft 79. The pin 141 allows limited longitudinal movement between the traveling shaft 79 and the upper skirt 103.

The lower end portion of the lower skirt 105 has ports 143 therein. These ports are arranged so as to be selectively aligned with the upper bypass ports 93 of the traveling shaft 79. The ports are located above the packing 55 of the data probe 21.

The packing 55 of the data probe will now be described with reference to FIG. 5. The packing 55 is located around the lower end of the lower skirt 105. The lower skirt 105 has a shoulder 145 that is located below the bypass ports 143. The packing 55 abuts against this shoulder 145. A packing gland 147 is below the packing 55. The packing gland 147 forms a shoulder 149 that seats onto the packing seat 61. A packing nut 151 is threaded onto the lower end of the lower skirt 105. The packing nut 151, in accordance with conventional practice, secures the packing 55 and the packing gland 147 onto the lower skirt.

Figure 4:
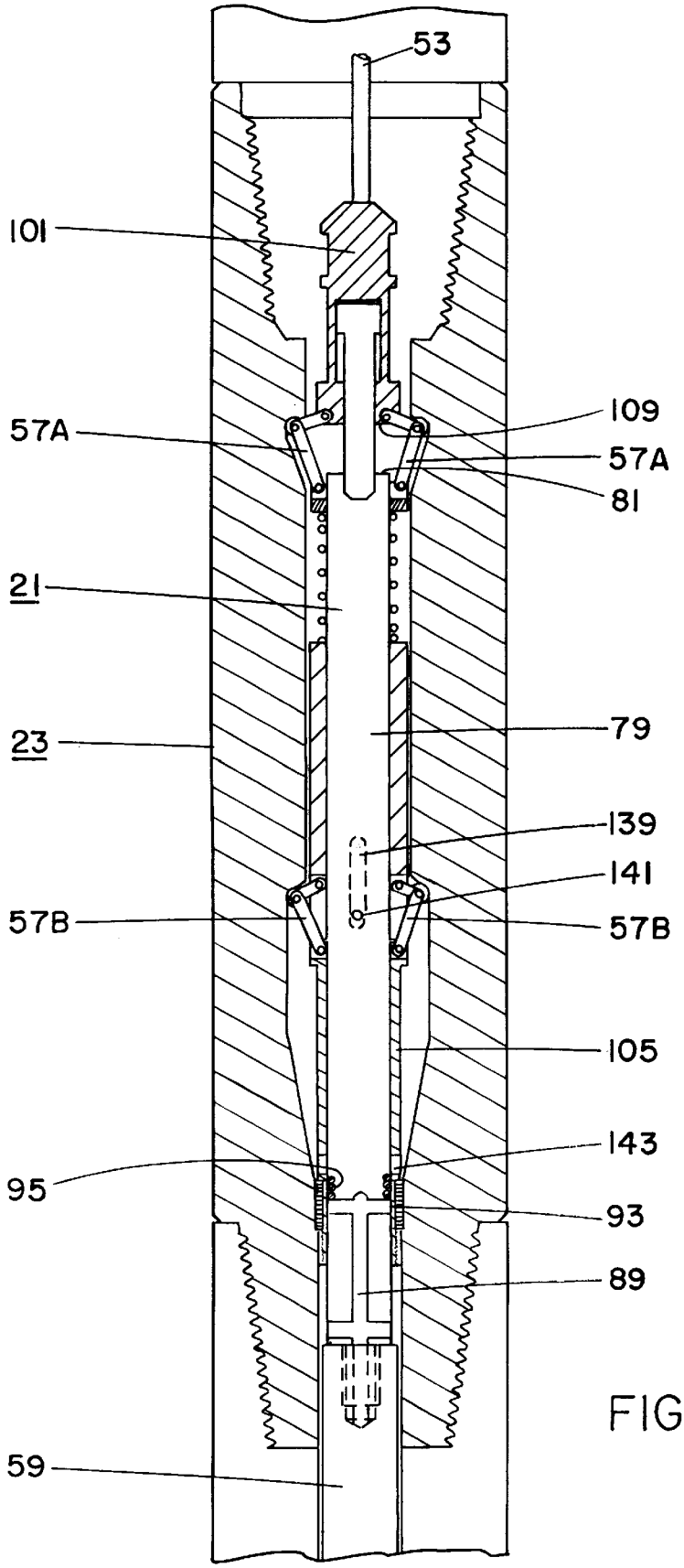
FIG. 4 is longitudinal cross-sectional view of the nipple and data probe of FIG. 2, with the data probe shown in the shut-in position.

The instrumentation carrier 59 is cylindrical. In FIGS. 2–4, only the upper end of the instrumentation carrier is shown. The upper end of the instrumentation carrier 79 threads onto the lower end of the traveling shaft 79. Thus, the instrumentation carrier 59 moves in unison with the remainder of the data probe as it moves up and down the drill stem. The instrumentation carrier has recorders located therein. There is a pressure recorder 153 and, if desired, a temperature recorder. The pressure recorder 153 has a pressure sensor that is exposed to the fluid in the drill stem. The recorded information can be accessed when the data probe is retrieved to the surface. Alternatively, a transmitter and an electronic wireline can be provided, wherein the information is telemetered to the surface while the instrumentation carrier stays down hole. Although pressure and temperature sensors have been described herein, other sensors can be utilized. The instrumentation carrier 59 also has a fluid reservoir 157 for retrieving a sample.

The operation of the data probe 21 will now be described. Referring to FIG. 1, the drill stem 17, with the nipple 23, is installed into the borehole 11 in accordance with conventional practice. The four phase tool is lowered in the open position, while the hydraulic tool is lowered in the closed position. Then, weight is applied to the drill stem 17 to set the packers 31 to isolate the formation from the drilling fluid.

The application of weight to the drill stem 17 also results in the opening of the hydraulic tool, wherein fluid from the formation flows up into the drill stem passage 39. This is the initial flow period and generally lasts 10–30 minutes.

After the initial flow period is the initial shut-in period. Using conventional techniques, the well would be closed or shut-in by rotating the drill stem five clockwise revolutions. This would close off the four phase tool (located inside of the test tool 19), wherein fluid from the formation would cease flowing into the drill stem.

However, the present invention provides an alternate way to shut-in the well, using the data probe 21. The data probe 21 is inserted into the drill stem 17 by way of the lubricator 41. Then, the data probe is lowered by the wireline 53 into the well inside of the drill stem passage 39. The well is shut-in by seating and latching the data probe 21 inside of the nipple 23. When the data probe 21 is seated in the nipple 23, the instrumentation carrier 59 is exposed to the formation fluid 62. Therefore, while the well is shut-in, pressure, temperature, and other desired information is recorded by the instrumentation in the instrumentation carrier 59.

The specifics of seating and latching the data probe 21 into the nipple 23 will now be discussed. When the data probe 21 is lowered in the drill stem 17, the latches 57A, 57B are in the stowed position and the data probe is configured as shown in FIG. 2. With the latches in the stowed position, the data probe can be easily be run up and down inside of the drill stem passage 39.

Information on the depth and type of fluid can be obtained during the descent of the data probe 21 in the drill stem (see FIG. 1). During the initial flow period, fluid will have traveled up the drill stem to a location above the nipple 23. As the data probe drops through the upper reaches of the drill stem, its speed of the descent will be relatively fast, because the data probe is traveling through gas (such as air or natural gas). The data probe will suddenly slow down when it contacts the top 62A of the fluid column inside of the passage 39. This is evident to the wireline operator on the surface by the slackening of the wireline 53. The wireline operator can determine, from the wireline counter 45, the depth of the fluid level from the surface. This information is useful for indicating formation pressures. In addition, the operator is able to approximate the type of fluid that has been produced in the drill stem by the amount of slack produced in the wireline as the data probe initially contacts the fluid. A hard fluid, such as water, produces more slack in the wireline than a softer fluid, such as oil. Also, if the data probe drops erratically once it has encountered fluid, then the fluid is likely to contain pockets of gas.

Figure 6:
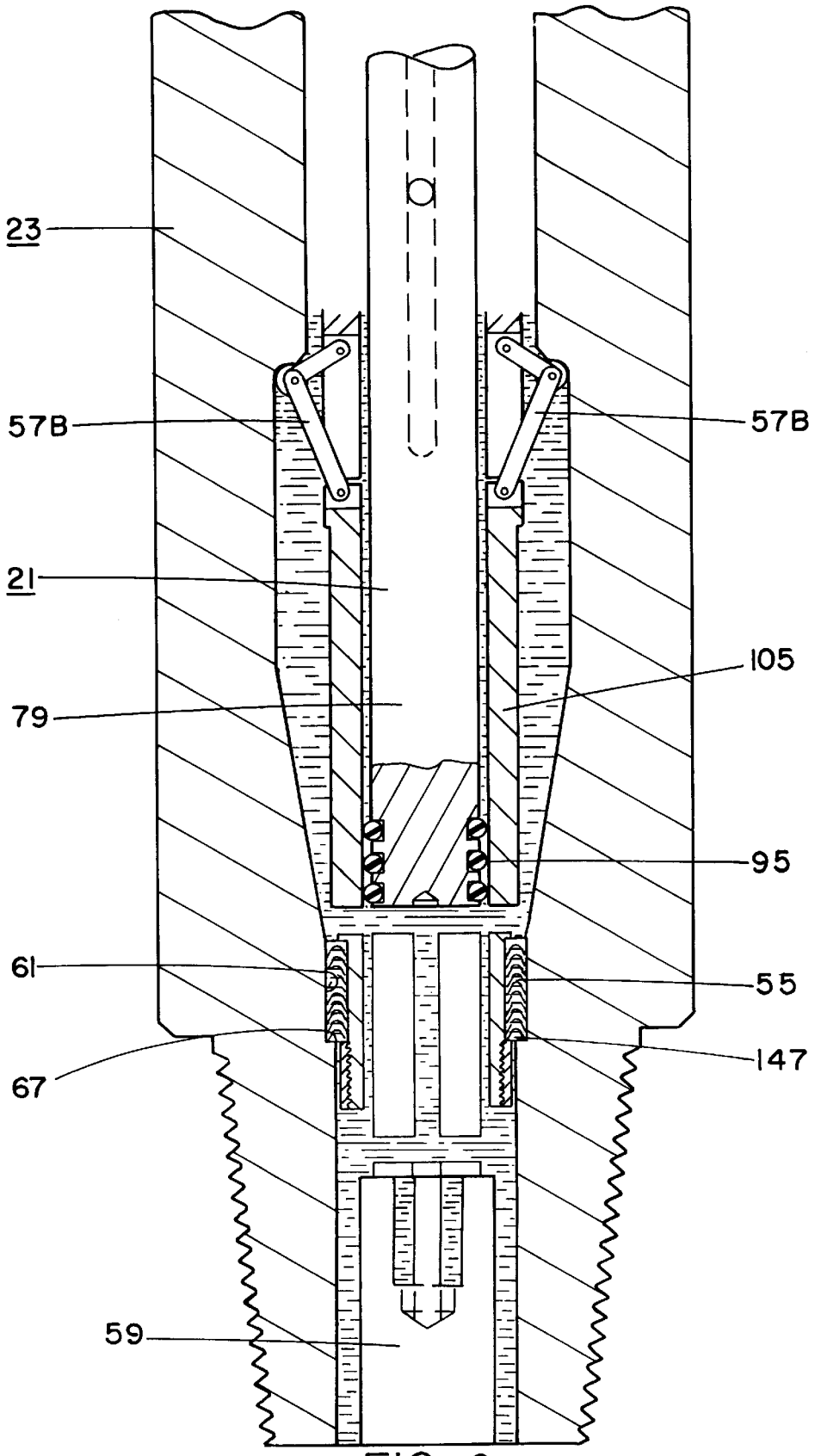
FIG. 6 is longitudinal cross-sectional close up view of the bottom portion of the data probe shown as partially set, so as to equalize pressure.

As the data probe 21 nears the nipple 23, the operator slows the speed of the descent. Referring to FIGS. 2 and 6, the data probe 21 enters the nipple 23 and the packing 55 seats in the nipple packing seat 61 and the packing gland 147 seats on the shoulder 67.

Once the packing gland 147 seats against the nipple shoulder 67, downward travel of the lower skirt 105 is almost completely halted. Therefore, the continued downward momentum of the wireline retrieval head 101 (which can be supplemented with sinker bars) pushes the upper skirt 103 down. This downward force is transmitted from the wireline retrieving head 101 to the upper skirt 103 by way of the upper toggle latches 57A (which are not yet aligned with the upper latch groove 71 and are thus prevented from deploying) and the spring 121 (which is relatively stiff). The downward movement of the upper skirt 103 relative to the lower skirt 105 causes the lower toggle latches 57B to deploy outwardly.

Figure 8:
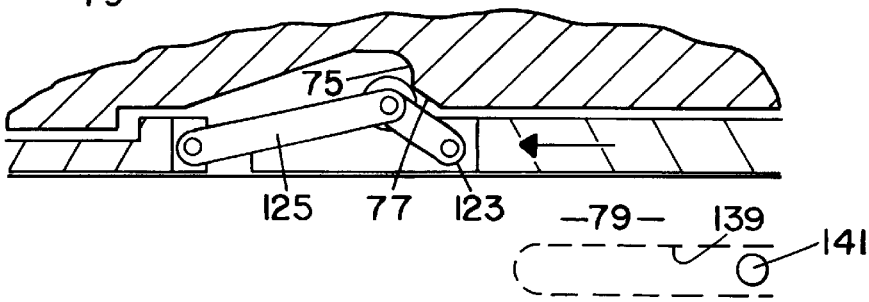
Figure 9:
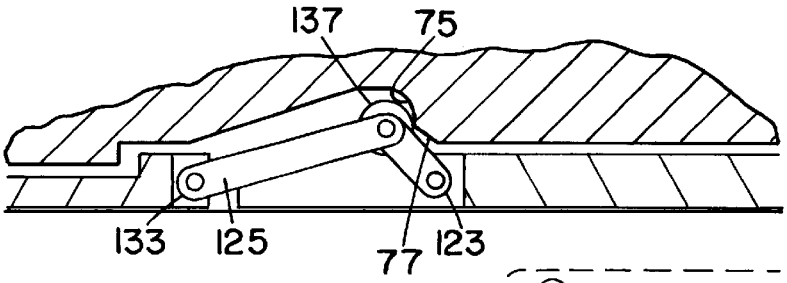

Referring to FIGS. 7–10, the deployment of the lower toggle latches 57B will be described. (In FIGS. 7–10, although only a lower toggle latch 57B is shown, the illustration is also representative of an upper toggle latch 57A) In the orientation of FIGS. 7–10, downhole is to the left, while uphole is the right. In FIG. 7, the packing has just seated in the nipple 23. This anchors the lower end 133 of the lower linkage bar 125. As downward force is exerted by the weight of the head 101 on the upper skirt 103, the upper end 131 of the upper linkage bar 123 is forced downwardly. This forces the roller 137 to deploy outwardly, away from the traveling shaft 79, as shown in FIG. 8. The roller 137 contacts the chamfered surface 77 just above the shoulder 75. Continued downward force by the head 101 against the latches compresses the packing and removes all slack (see FIG. 9). This also causes the lower end 133 of the lower linkage bar 125 to move downward slightly, wherein the roller 137 clears the chamfered surface 77 and contacts the shoulder 75. The latch becomes fully seated as shown in FIG. 10 when continued downward force by the wireline retrieval head 101 (FIG. 3) pushes the upper end 131 of the upper linkage bar 123 down, thereby forcing the roller 137 out and against the wall 74 of the groove 69. The latch 57B is now fully deployed and seated against the shoulder surface 75 of the groove 69. The data probe 21 is partially latched to the nipple 23, as shown in FIG. 3. The packing 55 is fully latched to the nipple.

Continued downward force by the head 101 closes the bypass 89 and deploys the upper latches 57A. As the wireline retrieval head 101 is forced down by its momentum, the ring 119 and the traveling shaft 79 are pushed down in unison. The upper latches 57A are prevented from deploying because they are not yet aligned with the groove 71. Consequently, the upper latches 57A push the ring 119 and traveling shaft 79 down. Downward travel of the traveling shaft 79 causes the upper ports 93 of the bypass 89 and the o-rings 95 to move down below the ports 143, as shown in FIG. 5. This shuts in the well.

The bypass 89 is retained in the closed position of FIG. 5 by the upper latches 57A. The upper toggle latches 57A are deployed in much the same way as are the lower toggle latches 57B. As the bypass 89 is closed by downward movement, the rollers 137 of the upper toggle latches 57A descend within the nipple passage 39A and become aligned with the chamfered surface of the upper groove 71. Further downward motion of the lower linkage bars, the ring 119 and the traveling shaft 119 is allowed by the spring 121. The wireline retrieval head 101 continues to exert downward force on the upper linkage bars of the upper toggle latches 57A, causing deployment of the upper toggle latches into the upper groove 71.

The data probe 21 is now latched in place inside of the nipple 23, as shown in FIG. 4. The data probe remains latched in place by maintaining the weight of the wireline retrieval head 101 on the upper toggle latches 57A.

The distance between the shoulders 75 in the two grooves 69, 71 is less than the distance between the rollers 137 of the upper and lower latches 57A, 57B, as can be seen in FIG. 2. This difference in distances provides that the upper latches deploy sequentially with respect to the lower latches. The lower latches 57B deploy first, followed by the deployment of the upper latches 57A. The upper latches are unable to be deployed until the lower latches deploy, due to the upper latches not yet being aligned with the upper groove 71.

Moving the traveling shaft 79 down to close the bypass causes the pin 141 to move down in the slot 139 (see FIG. 4). The pin 141 is coupled to the traveling shaft 79, while the slot 139 is formed in the lower skirt 105. The pin and slot arrangement is used to unlatch the lower toggle latches 57B, as will be discussed hereinafter.

At this stage, the well is completely shut-in. Fluid 62 pressure is allowed to increase for the shut-in period.

The instrumentation carrier 59 is located in the bomb chamber 33 just below the packing 55. Consequently, the carrier 59 is immersed in the fluid 62 and is subjected to formation pressures. This allows the formation fluid pressure to be recorded. Also, a portion of the fluid 62 enters the sampling chamber 157 (see FIG. 5).

Figure 11:
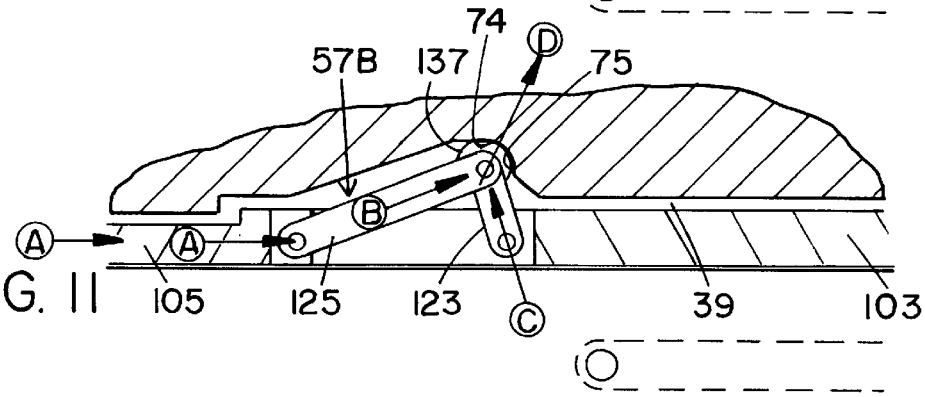

The data probe 21 is capable of withstanding large formation pressures. Referring to FIGS. 5 and 11, the pressure from the formation attempts to push the packing, the lower skirt 105 and the traveling shaft 79 up the drill stem. This fluid pressure force (shown as "A" in FIG. 11) is vectored (shown as "B") along the longitudinal axis of the lower linkage bar 125 of each of the lower toggle latches 57B. In addition, this fluid pressure force is opposed by the downward force of the wireline retention head 101 and its weight, which downward force is vectored (shown as "C") along the longitudinal axis of each of the upper linkage bars 123 of the lower toggle latches 57B. The resultant force of forces "B" and "C" is shown as "D" in FIG. 11. This resultant force "D" is directed into the corner of surfaces 74, 75 and well away from the passage 39. Consequently, the lower toggle latches 57B will not accidently slip out of the groove 69. The upper toggle latches are 57A are similarly configured in order to prevent accidental unlatching by pressure acting on the traveling shaft 79.

The shut-in period of the well is followed by either a flow period, or the end of the test. In either circumstance, the pressure on the uphole and downhole sides of the packing 55 (see FIG. 5) should be equalized before retrieving the data probe. Equalization of pressure occurs with the bypass 89. To equalize the pressure, the wireline operator picks up on the wireline 53 until the weight indicator shows some gain. Then, the wireline operator picks up on the wireline a few inches. This action lifts the wireline retrieval head 101 a few inches (see FIGS. 3 and 4). This unlatches the upper latches 57A by pulling upwardly on the upper linkage bar 123 of each latch (see FIGS. 10 and then 9). As the upper linkage bar 123 is pulled up, the roller 137 moves in towards the traveling shaft and out of the nipple groove (see FIGS. 8 and 7). The latches are now in the stowed position as shown in FIG. 7.

When the upper latches 57A become stowed, any continued upward movement by the wireline retrieval head 101 will be transmitted through the upper latches to the ring 119. Consequently, continued upward movement of the head 101 pulls up on the ring 119, thereby raising the traveling shaft 79. This opens the bypass 89 by aligning the upper ports 93 with the ports 143 of the lower skirt 105 (see FIG. 6)

Opening the bypass allows pressure across the packing 55 to equalize. Fluid flows from the downhole side of the data probe to the uphole side through the bypass 89, through the annulus between the data probe 21 and the nipple 23, and up towards the surface 13 inside of the drill stem passage 39. An immediate blow will be indicated at the surface therefore assuring successful opening of the bypass 89.

Lifting the wireline retrieval head 101 a few inches to open the bypass 89 also moves the pin 141 to the top of the slot 139. Thus, any further upward movement of the traveling shaft 79 will also raise the upper skirt 103.

After the pressure across the data probe has equalized, the wireline operator picks up the wireline 53, which raises the wireline retrieval head 101. This pulls the traveling shaft 79 up (by the upper latches 57A and the ring 119). The traveling shaft 79 pulls the upper skirt 103 up (by the pin 141 acting the upper end of the slot 139). Moving the upper skirt up unlatches the lower toggle latches 57B. The lower toggle latches are unlatched as follows (see FIGS. 7–10 in reverse order): the upper skirt 103 pulls the upper ends 131 of the upper linkage bars 123 up. This pulls the rollers 137 out of the groove 69 to unlatch the lower toggle latches 57B. The upward tension on the spring 121 before the pin 141 touches the top of the slot 139 assists in unlatching the lower latches 57B.

The pin 141 is useful in case the data probe 21 becomes stuck in the hole. Lifting with the wireline can produce sufficient force to shear the pin 141 inside of the slot. The allows the retrieval of the head 101, the upper latches 57A, the traveling shaft 79, and the instrumentation carrier 59, to the surface. In this manner the information can at least be retrieved from downhole. The skirts 103, 105, the lower latches 57B, and the packing 55 is left downhole for subsequent retrieval when the drill string is pulled from the hole.

The data probe 21 is now completely unlatched from the nipple 23. The well begins a flow period, wherein fluid from the formation flows up into the drill stem. During this flow period of the drill stem test, the data probe 21 is retrieved to the surface (the nipple 23 remains downhole with the rest of the drill stem 17). At the surface, the data probe reenters the lubricator 41 (see FIG. 1). The valve 47 below the lubricator is closed and the data probe is retrieved from the lubricator.

The pressure and other recorded information is retrieved from the instrumentation carrier 59 for analysis. In addition, the fluid sample is obtained from the instrumentation carrier 59. Based upon this recorded information and sample, the drill stem testing can either be continued or terminated. If the results from the data probe look promising, the drill stem test can be continued, wherein additional shut-in and flow periods are made. The data probe 21 can be dropped down the drill stem to seat in the nipple 23 in order to shut-in the well for the next shut-in period. Alternatively, the well can be shut-in and reopened using the conventional four phase tool in the test tool 19. Occasionally, the results from the data probe 21 show a well with high productivity, wherein further testing is deemed unnecessary. Instead of waiting for the drill stem test to run its course, the well can be completed right then. This saves time, thereby making the well more economical to drill. Sometimes, the results from the data probe 21 shows a well with little or no commercial productivity (such as salt water production). The drill stem test can be immediately terminated and the zone of interest is condemned. The decision can be made to drill deeper or to plug the well. This saves drilling costs that would ordinarily be incurred for a worthless zone or well.

The invention has so far been described in conjunction with the drilling of wells. However, the invention can also be used in producing wells. From time to time, it is desirable to test the production of a producing well. During such a production test, the well is shut-in and the formation pressure is allowed to increase. The increase in pressure provides useful information on the production capabilities of the well.

Figure 12:
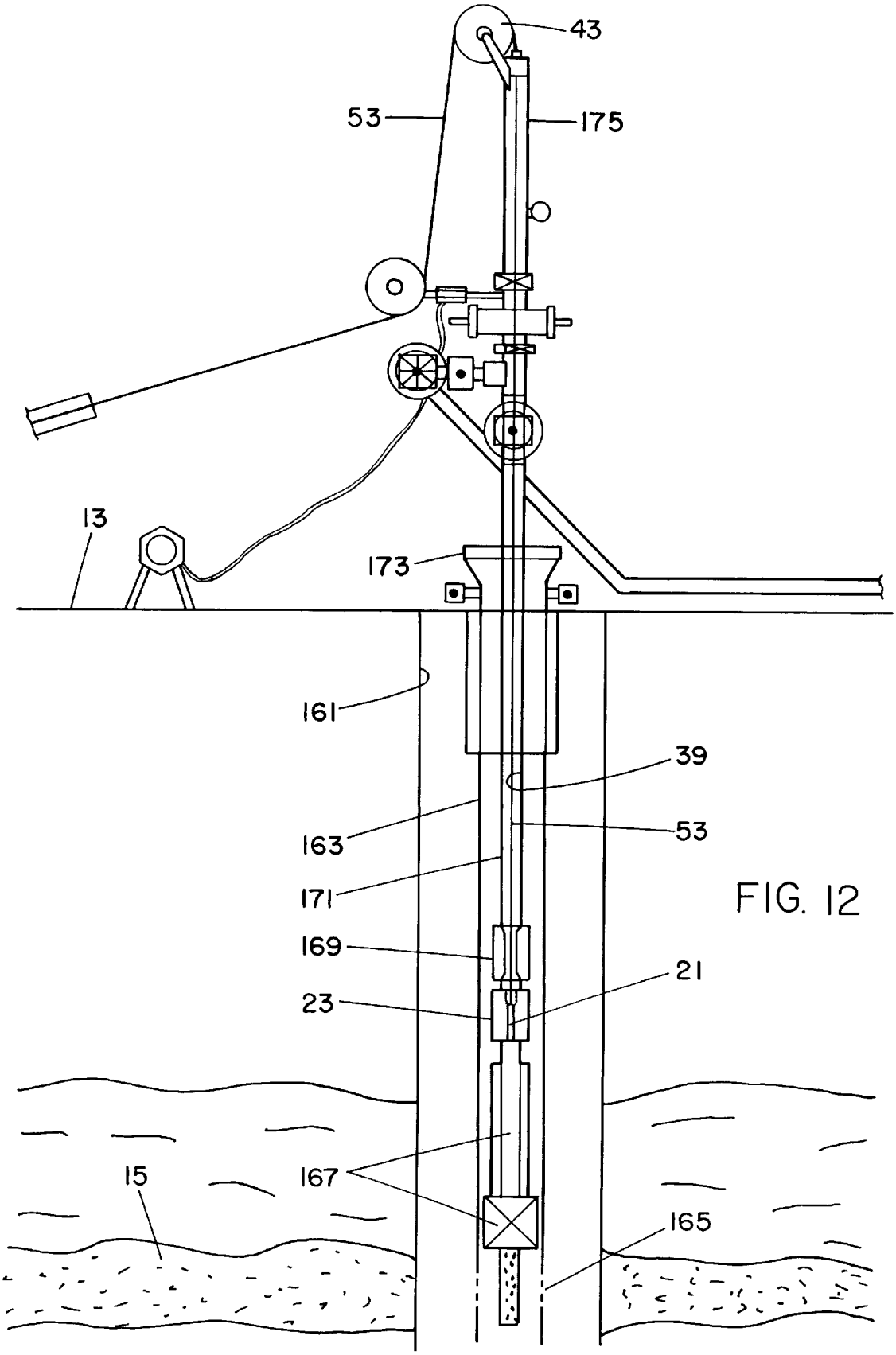
FIG. 12 is a longitudinal cross-sectional view of the present invention as used in a production well.

In FIG. 12, there is shown a view of a producing well 161. The well 161 extends in the formation of interest 15. Production equipment is in place. This equipment includes casing 163. The casing is perforated 165 at the formation 15. A packer 167 isolates the formation 15. The nipple 23 is located above the packer 167. Located above the nipple 23 is a standard seating nipple 169 found in many producing wells. A string of tubing 171 extends from the standard nipple 169 to the surface 13. A well head 173 and other equipment is also provided. The nipple 23 is installed downhole when the well is completed or when the tubing string is pulled.

During a production test, the data probe 21 is inserted into the well via a lubricator 175. A wireline 53 is used to raise and lower the data probe 21.

The data probe 21 can be used to shut-in the production well and acquire pressure data. The data probe 21 is dropped down inside the tubing on a wireline 53. It seats inside of the nipple 23, as discussed hereinbefore. Once the data probe is seated, the well is shut-in from a downhole location. Formation fluid pressure is allowed to build, which build up is recorded by the data probe instrumentation.

The well need only be shut-in for a relatively short time (for example, 24 hours) compared to conventional production well testing. Because the well is shut-in from a downhole location close to the formation, the entire column of tubing 171 need not be pressurized by the formation fluid, as with conventional testing. Therefore, use of the data probe in a production well test saves time.

After the well has been shut-in for a suitable period of time, the data probe is released from the nipple 23, as discussed hereinbefore. The data probe is then retrieved to the surface, for analysis of the data.

With the exception of the seals, which are made of rubber, the nipple and the probe are made of metal.

The foregoing disclosure and the showings made in the drawings are merely illustrative of the principles of this invention and are not to be interpreted in a limiting sense.

I claim:

1. An apparatus for testing the production capability of a well extending into an earth formation, comprising:

a) a nipple having first and second ends and an interior passage extending between the first and second ends, the nipple having a longitudinal axis extending between the first and second ends, the first and second ends being structured and arranged to be coupled to a well tubing such that the interior passage communicates with a passage inside of the well tubing;

b) the nipple comprising first and second recesses in the interior passage, the first and second recesses being spaced apart from each other longitudinally along the interior passage;

c) the nipple comprising a seat in the interior passage;

d) a probe having two ends and being structured and arranged to traverse through the passage of the well tubing, the probe having a seal that cooperates with the nipple seat in the interior passage so as form a seal in an annular region between the probe and the nipple;

e) the probe comprising an information gathering member that is located at one of the ends of the probe;

f) the probe comprising a wireline coupler that is located at the other of the ends of the probe, the wireline coupler being structured and arranged to be coupled to a wireline;

g) the probe comprising a bypass member that extends through an interior of the seal, the bypass member having a bypass passageway, the bypass member being moveable relative to the seal between an open position and a closed position, with the bypass passageway allowing fluid in the interior passage of the nipple to flow past the seal when the bypass member is in the open position, and with fluid in the interior passage of the nipple being prevented from flowing past the seal when the bypass member is in the closed position;

h) the probe comprising first and second latches, the first latch being connected to the seal, the second latch being connected to the bypass member, the first latch being structured and arranged to be received by the first recess in the nipple and the second latch being structured and arranged to be received by the second recess in the nipple, each of the first and second latches being moveable between a deployed position, wherein the respective first or second latch is received by the respective first or second recess, and a stowed position, wherein the respective first or second latch is clear of the respective first or second recess so as to allow the probe to traverse through the interior passage, the first and second latches being connected together in series so as to move between the respective deployed and stowed positions sequentially.

2. The apparatus of claim 1 wherein the first latch comprises first and second linkages, each of the first and second linkages having a first end and a second end, with the second ends of the first and second linkages being pivotally coupled together, the first end of the first linkage being pivotally coupled to the seal, the first end of the second linkage being pivotally coupled to an intermediate member, the intermediate member being coupled with the wireline coupler.

3. The apparatus of claim 2 further comprising a roller rotatably coupled to the second ends of the first and second linkages.

4. The apparatus of claim 2 wherein the first recess comprises a shoulder surface for receiving and retaining the second ends of the first and second linkages.

5. The apparatus of claim 4 wherein each of the first and second linkages have a longitudinal axis between the respective first and second ends, the angle between the longitudinal axes of the first and second linkages being about 86–91 degrees when the first latch is in the deployed position.

6. The apparatus of claim 2 wherein the intermediate member is coupled to the wireline coupler by way of the second latch.

7. The apparatus of claim 2 wherein the intermediate member is coupled to the wireline coupler by way of the second latch and a spring.

8. The apparatus of claim 2 wherein the intermediate member is coupled to the bypass member by way of a pin and slot arrangement, with the slot being oriented so as to permit the pin to alternately traverse towards the first and second ends of the probe.

9. The apparatus of claim 2 wherein the second latch comprises third and fourth linkages, each of the third and fourth linkages having a first end and a second end, with the second ends of the third and fourth linkages being pivotally coupled together, the first end of the third linkage being pivotally coupled to the bypass member, the first end of the fourth linkage being pivotally coupled to the wireline coupler.

10. The apparatus of claim 1 wherein the information gathering member comprises a pressure sensing instrument.

11. The apparatus of claim 1 wherein the information gathering member comprises a sampling chamber.

12. The apparatus of claim 2 wherein:

a) the first latch comprises first and second linkages, each of the first and second linkages having a first end and a second end, with the second ends of the first and second linkages being pivotally coupled together, the first end of the first linkage being pivotally coupled to the seal, the first end of the second linkage being pivotally coupled to an intermediate member;

b) the second latch comprises third and fourth linkages, each of the third and fourth linkages having a first end and a second end, with the second ends of the third and fourth linkages being pivotally coupled together, the first end of the third linkage being pivotally coupled to the bypass member, the first end of the fourth linkage being coupled to the wireline coupler;

c) a first roller rotatably coupled to the second ends of the first and second linkages, and a second roller rotatably coupled to the second ends of the third and fourth linkages;

d) the first recess comprises a shoulder surface for receiving and retaining the second ends of the first and second linkages, and the second recess comprises a shoulder surface for receiving and retaining the second ends of the third and fourth linkages;

e) the intermediate member is coupled to the third linkage of the second latch by way of a spring;

f) the information gathering member comprises a pressure sensing instrument and a sampling chamber.

13. An apparatus for testing the production capability of a well extending from the surface of the earth into a formation, comprising:

a) tubing extending along the inside of the well from the surface to the formation, the tubing having an interior passage therein, which passage extends from the surface to the formation;

b) the tubing having packing at a location above the formation;

c) the tubing having a nipple therein, the nipple located above the packing, the interior passage passing through the nipple, the nipple having two recesses in the interior passage, the recesses being longitudinally spaced apart from each other, the nipple having a seat in the interior passage;

d) a probe having a seal that is structured and arranged to engage the nipple seat, the probe having an information gathering member located so as to be exposed to fluid from the formation when the seal engages the nipple seat;

e) the probe comprising a bypass member that extends through an interior of the seal, the bypass member having a bypass passageway, the bypass member being moveable relative to the seal between an open position and a closed position, with the bypass passageway allowing fluid in the interior passage to flow past the seal when the bypass member is in the open position, and with fluid in the interior passage being prevented from flowing past the seal when the bypass member is in the closed position;

f) the probe comprising first and second latches, the first latch being connected to the seal, the second latch being connected the bypass member, the first latch being structured and arranged to be received by one of the recesses in the nipple and the second latch being structured and arranged to be received by the other of the recesses in the nipple, each of the first and second latches being moveable between a deployed position, wherein the respective first or second latch is received by the respective recess in the nipple, and a stowed position, wherein the respective first or second latch is clear of the respective recess so as to allow the probe to traverse through the interior passage, the distance between the two recesses in the nipple being smaller than the distance between the first and second latches when the first and second latches are in the stowed position.

14. The apparatus of claim 13 wherein the tubing comprises a drill stem.

15. The apparatus of claim 13 wherein the tubing comprises production tubing.

16. A method of testing the production of a well, the well extending from the surface of the ground into a formation, the well having a length of tubing from the surface to the formation, the tubing having an interior passage therein, which interior passage communicates with the formation, the well being packed off in an annulus around the tubing at a location that is above the formation, wherein fluid from the formation is allowed to enter the interior passage of the tubing, comprising the steps of:

a) dropping a probe inside of the interior passage, the probe having a seal and a bypass around the seal;

b) seating the probe seal into a portion of the tubing;

c) latching the seal in place by deploying a first latch on the probe so as to engage the tubing;

d) closing the bypass around the seal;

e) latching the bypass in a closed position by deploying a second latch on the probe so as to engage the tubing, wherein the well is shut in;

f) unlatching the second latch from the tubing;

g) opening the bypass around the seal so as to open the well;

h) equalizing pressure across the seal through the bypass;

i) unlatching the first latch from the tubing;

j) unseating the seal from the tubing;

k) retrieving the probe to the surface.

17. The method of claim 16, further comprising the steps of:

a) providing instrumentation on the probe;

b) while the well is shut in, monitoring phenomena of the well with the instrumentation.

18. The method of claim 16, further comprising the steps of:

a) providing a weight at a top end of the probe;

b) after the probe seal seats into a portion of the tubing, driving the weight down so as to deploy the first latch on the probe;

c) after deploying the first latch on the probe, continuing to drive the weight down so as to close the bypass and deploy the second latch on the probe.

19. The method of claim 16, wherein:

a) the step of dropping a probe inside of an interior passage further comprises the step of connecting a wireline to the probe and dropping the probe with the wireline inside of the interior passage;

b) maintaining the wireline in connection with the probe;

c) the step of unlatching the second latch from the tubing further comprises the step of picking up with the wireline a predetermined distance;

d) the step of unlatching the first latch from the tubing further comprises the step of picking up with the wireline a further distance.

20. The method of claim 16 wherein:

a) the steps b)–f) of claim 16 occur during a shut-in period of a drill stem test;

b) after the well is opened by opening the bypass, allowing the well to flow for a period of time.

* * * * *